US011788193B2

(12) United States Patent
Botte

(10) Patent No.: US 11,788,193 B2
(45) Date of Patent: Oct. 17, 2023

(54) ELECTROCHEMICAL CELLS AND ELECTROCHEMICAL METHODS

(71) Applicant: Ohio University, Athens, OH (US)

(72) Inventor: Gerardine G. Botte, Athens, OH (US)

(73) Assignee: Ohio University, Athens, OH (US)

( * ) Notice: Subject to any disclaimer, the term of this patent is extended or adjusted under 35 U.S.C. 154(b) by 10 days.

(21) Appl. No.: 15/570,848

(22) PCT Filed: Apr. 29, 2016

(86) PCT No.: PCT/US2016/029950

§ 371 (c)(1),
(2) Date: Oct. 31, 2017

(87) PCT Pub. No.: WO2016/178948

PCT Pub. Date: Nov. 10, 2016

(65) Prior Publication Data

US 2018/0148846 A1 May 31, 2018

Related U.S. Application Data

(60) Provisional application No. 62/157,103, filed on May 5, 2015.

(51) Int. Cl.
*C25B 3/03* (2021.01)
*C25B 3/23* (2021.01)
(Continued)

(52) U.S. Cl.
CPC ..... *C25B 1/00* (2013.01); *C25B 3/23* (2021.01); *C25B 3/25* (2021.01); *C25B 9/17* (2021.01)

(58) Field of Classification Search
CPC .... C25B 3/02; C25B 3/04; C25B 3/03; C25B 3/23; C25B 3/26
(Continued)

(56) References Cited

U.S. PATENT DOCUMENTS 4,959,131 A 9/1990 Cook et al.
5,064,733 A * 11/1991 Krist ..... H01M 4/9016 429/489
(Continued)

OTHER PUBLICATIONS

Mugele, "Unobtrusive Graphene Coatings," Nature Materials (Mar. 2012), vol. 11, pp. 182-183. (Year: 2012).*
(Continued)

*Primary Examiner* — Edna Wong
(74) *Attorney, Agent, or Firm* — Wood Herron & Evans LLP

(57) ABSTRACT

An electrochemical cell and method for reducing carbon dioxide and/or dehydrogenating a hydrocarbon to an olefin are provided. The electrochemical cell includes a cathode having a first conducting component that is active toward adsorption and reduction of an oxidizing agent such as $CO_2$; and an anode having a second conducting component that is active toward adsorption and oxidation of a reducing agent such as a hydrocarbon. Additionally, a hydrophobic modifier is present on at least a portion of a surface of the second conducting component or both the first and second conducting components. The method includes exposing the cathode to a $CO_2$-containing fluid; exposing the anode to a hydrocarbon-containing fluid; and applying a voltage between the cathode exposed to the $CO_2$-containing fluid and the anode exposed to the hydrocarbon-containing fluid, wherein the voltage is sufficient to simultaneously oxidize the hydrocarbon via a dehydrogenation reaction and reduce the $CO_2$.

6 Claims, 1 Drawing Sheet

(51) Int. Cl.

| | |
|---|---|
| ***C25B 3/26*** | (2021.01) |
| ***C25B 1/00*** | (2021.01) |
| ***C25B 3/25*** | (2021.01) |
| ***C25B 9/17*** | (2021.01) |

(58) Field of Classification Search
USPC ..... 205/413, 462, 555
See application file for complete search history.

(56) References Cited

U.S. PATENT DOCUMENTS

| | | | | |
|---|---|---|---|---|
| 2003/0155254 | A1 | 8/2003 | Mazanec et al. | |
| 2009/0023050 | A1* | 1/2009 | Finnerty | H01M 8/0637 429/411 |
| 2013/0105330 | A1* | 5/2013 | Teamey | C25B 13/08 205/349 |
| 2013/0118910 | A1* | 5/2013 | Teamey | C25B 1/00 205/427 |
| 2015/0345034 | A1* | 12/2015 | Sundara | C25B 9/23 205/462 |
| 2016/0017503 | A1* | 1/2016 | Kaczur | C25B 3/25 205/346 |
| 2016/0222528 | A1* | 8/2016 | Bedell | C25B 9/08 |
| 2016/0281245 | A1* | 9/2016 | Rinzler | C25B 13/02 |

OTHER PUBLICATIONS

Kopljar et al., "Electrochemical Reduction of CO2 to Formate at High Current Density Using Gas Diffusion Electrodes," Journal of Applied Electrochemistry (Oct. 2014), vol. 44, No. 10, pp. 1107-1116. (Year: 2014).*

Hara et al., "Electrocatalytic Formation of CH4 from CO2 on a Pt Gas Diffusion Electrode," Journal of the Electrochemical Society (Feb. 1, 1997), vol. 144, No. 2, pp. 539-545. (Year: 1997).*

Shao et al., "Facile and Controllable Electrochemical Reduction of Graphene Oxide and Its Applications," Journal of Materials Chemistry (2010), vol. 20, No. 4, pp. 743-748. (Year: 2010).*

Chen et al., "Direct Electrodeposition of Reduced Graphene Oxide on Glassy Carbon Electrode and Its Electrochemical Application," Electrochemistry Communications (Feb. 1, 2011), vol. 13, No. 2, pp. 133-137. (Year: 2011).*

International Searching Authority, Search Report and Written Opinion issued in International Application No. PCT/US2016/029950 dated Sep. 19, 2016 (12 pages).

* cited by examiner

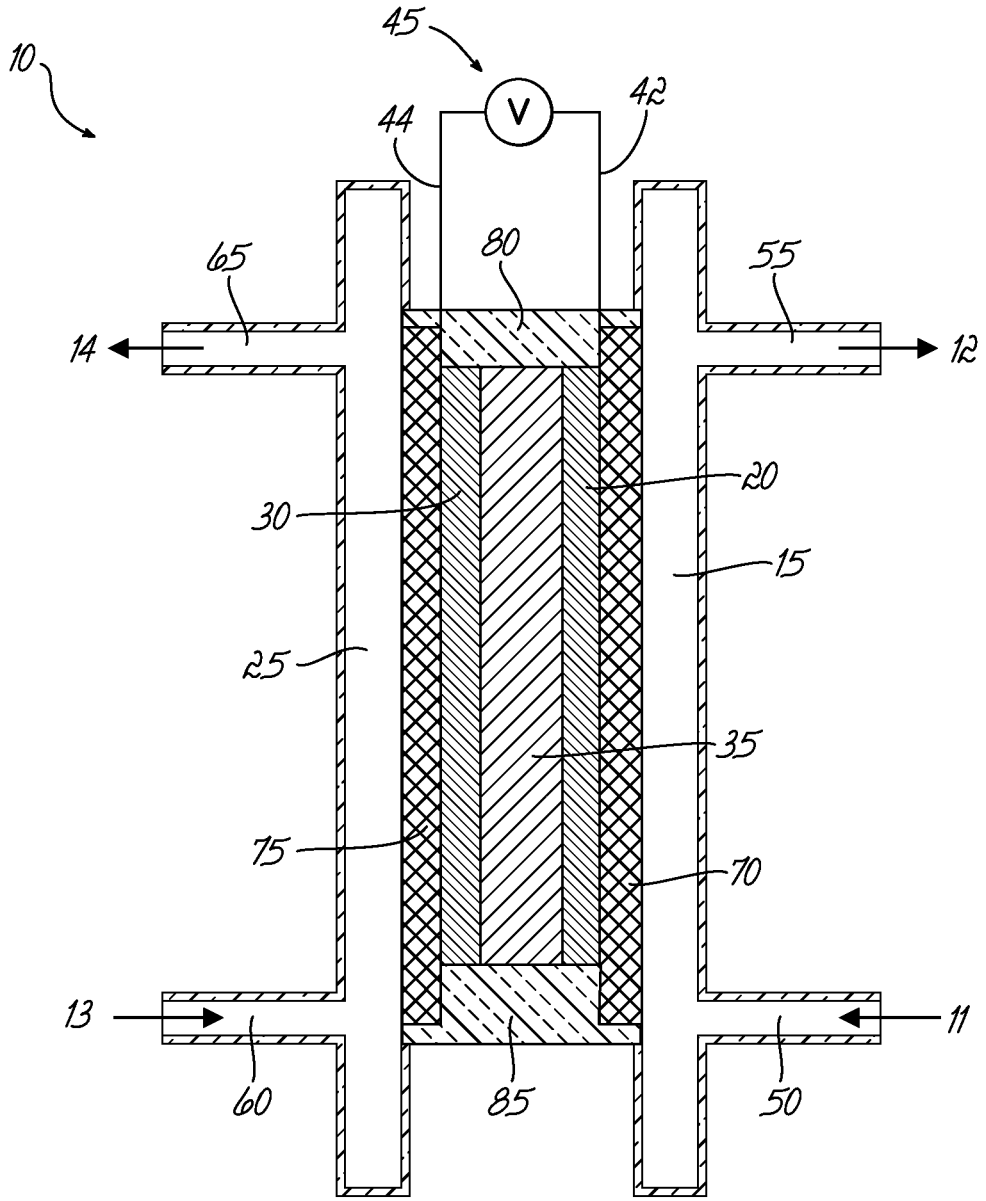
10
45
V
44
42
65
80
55
14
12
30
20
15
25
35
75
70
13
11
60
85
50

ELECTROCHEMICAL CELLS AND ELECTROCHEMICAL METHODS

CROSS-REFERENCE TO RELATED APPLICATIONS

This application is a National Stage Entry under 35 U.S.C. § 371 of PCT Application No. PCT/US2016/029950, filed on Apr. 29, 2016, which claims the benefit of U.S. Application Ser. No. 62/157,103, filed May 5, 2015, the disclosures of which are hereby incorporated by reference herein in their entireties.

FIELD OF THE INVENTION

This invention relates to electrochemical cells and methods for reducing carbon dioxide, oxidizing hydrocarbons, or a combination thereof.

BACKGROUND

Carbon dioxide ($CO_2$) is the chief greenhouse gas that results in global warming and climate change. However, $CO_2$ is a highly desirable carbon feedstock that can also be used to produce large volumes of industrial chemicals and fuels, such as carbon monoxide (CO), methanol, ethylene, and formic acid. While the conversion of $CO_2$ to useful fuels has been proposed and explored through different routes (e.g., photochemical, biochemical, and electrochemical conversion), many of these routes suffer from low efficiencies or occur under extreme temperatures and pressures.

With respect to electrochemical conversion, it has been demonstrated that the electrochemical reduction of $CO_2$ can produce CO, methane, formic acid, etc. using solid oxide electrolyte-type electrolyzers at 800° C. to 1000° C. operating temperature, and liquid electrolyte-type electrolyzers have been demonstrated operating around room temperature. Various metal catalysts and coordination complexes have been studied for the electrochemical reduction of $CO_2$ in liquid electrolytes.

Even though the electrochemical reduction of $CO_2$ is a promising candidate process for $CO_2$ recycling and synthetic fuel production, it encounters technical challenges, such as high operating voltage and low conversion yields that affect the economics and the implementation of the process.

With respect to high operating voltages, typically in the electrochemical process, $CO_2$ is reduced at the cathode while water is oxidized at the anode. The overpotential for the oxidation of water increases the cell voltage. For example, the reduction of carbon dioxide to ethylene takes place at 0.079 V vs. standard hydrogen electrode (SHE) according to Equation (1) (*All the half cell electrode potentials listed herein are reduction electrode potentials vs. SHE V (electrolysis cell)):

$$2CO_2+12H^++12e^- \rightleftharpoons C_2H_4+4H_2O_{(eq)} E^0=0.079^*\text{V vs. SHE} \quad (1)$$

While the oxidation of water takes place at 1.23 V vs. SHE according to Equation (2):

$$6H_2O \rightleftharpoons 12H^++3O_2+12e^- E^0=1.23 \text{ V vs. SHE} \quad (2)$$

Accordingly, the overall cell reaction is provided according to Equation (3):

$$2CO_2+2H_2O \rightarrow 3O_2+C_2H_4 \quad (3)$$

with a thermodynamics potential of 1.151 V. However, the high surface overpotential for the water oxidation reaction increases the cell voltage significantly.

With respect to low conversion, reduction of protons can also occur at the cathode (see Equation (4)), which can thereby compete with the desired reduction of $CO_2$ and lead to low conversions of $CO_2$.

$$2H^++2e^- \rightleftharpoons E^0=0 \text{ V vs. SHE} \quad (4)$$

Accordingly, prior electrochemical methods of reducing $CO_2$ are hampered with high-energy consumption (high operating voltage), low conversion to high value products, and low selectivity, which prevent the implementation of the process.

Similarly, dehydrogenating hydrocarbons to olefins is an important commercial hydrocarbon conversion process because of the great demand for olefinic products for the manufacture of various chemical products such as detergents, high octane motor fuels, pharmaceutical products, plastics, synthetic rubbers, and other products well known to those skilled in the art. The process is traditionally carried at high temperatures, such as between 550° C. and 650° C., and in the presence of a metal-based catalyst. Due to the high temperature, the catalyst is quickly and easily coked, and the period of time during which the catalyst is stable is limited, in some instances to minutes or even seconds. While the stability of the catalyst can be somewhat improved by using it in a form of a fluidized bed, traditional catalytic dehydrogenation of hydrocarbons has other drawbacks and deficiencies besides problems with stability. For example, in traditional catalytic dehydrogenation many catalysts cannot withstand many cycles of regeneration and heat integration without substantial loss of activity and selectivity. The ability of catalysts to promote selective reactions (i.e., reactions leading to the formation of the desired final product) is also limited in traditional processes, and the share of thermal, non-selective reactions (i.e., reactions leading to the formation of the products other than the desired product) is often larger than desired.

In view of the foregoing, there is a need for new electrochemical cells, as well as new electrochemical methods for reducing $CO_2$, for the dehydrogenation of hydrocarbons to corresponding olefins, or combinations thereof.

SUMMARY OF THE INVENTION

The present invention overcomes one or more of the foregoing problems and other shortcomings, drawbacks, and challenges of conventional carbon dioxide reduction, conventional dehydrogenation of hydrocarbons to olefins, or combinations thereof. While the invention will be described in connection with certain embodiments, it will be understood that the invention is not limited to these embodiments. To the contrary, this invention includes all alternatives, modifications, and equivalents as may be included within the scope of the present invention.

According to an embodiment of the present invention, an electrochemical cell for reducing carbon dioxide is provided. The electrochemical cell comprises a cathode compartment including a cathode comprising a first conducting component that is active toward adsorption and reduction of $CO_2$; and an anode compartment including an anode comprising a second conducting component that is active toward adsorption and oxidation of a reducing agent. The reducing agent may include, but is not limited to, hydrogen, hydrocarbons, amines, alcohols, coal, pet-coke, biomass, lignin, or combinations thereof. The electrochemical cell may be employed in a method for reducing carbon dioxide.

According to another embodiment of the present invention, an electrochemical cell for dehydrogenating a hydrocarbon to an olefin is provided. The electrochemical cell comprises a cathode compartment including a cathode comprising a first conducting component that is active toward adsorption and reduction of an oxidizing agent; and an anode compartment including an anode comprising a second conducting component that is active toward adsorption and oxidation of a hydrocarbon to an olefin. The oxidizing agent may include, but is not limited to, oxygen, carbon dioxide, molecular halogens, metal ions, protons, or combinations thereof. Additionally, a hydrophobic modifier is present on at least a portion of a surface of the second conducting component or both the first and second conducting components. The electrochemical cell may be employed in a method for dehydrogenating a hydrocarbon to an olefin.

According to another embodiment of the present invention, an electrochemical cell for reducing carbon dioxide and dehydrogenating a hydrocarbon to an olefin is provided. The electrochemical cell comprises a cathode compartment including a cathode comprising a first conducting component that is active toward adsorption and reduction of $CO_2$; and an anode compartment including an anode comprising a second conducting component that is active toward adsorption and oxidation of a hydrocarbon to an olefin. Additionally, a hydrophobic modifier is present on at least a portion of a surface of the second conducting component or both the first and second conducting components.

According to an embodiment of the present invention, a method for concurrently electrolytically reducing carbon dioxide and dehydrogenating a hydrocarbon to an olefin in an electrochemical cell comprising a cathode, an anode, and a separator is provided. The method includes exposing the cathode comprising a first conducting component to a carbon dioxide ($CO_2$)-containing fluid at a first pressure and first temperature, wherein the first conducting component is active toward adsorption and oxidation of $CO_2$; exposing the anode comprising a second conducting component to a hydrocarbon-containing fluid at a second pressure and a second temperature, wherein the second conducting component is active toward adsorption and reduction of hydrocarbons via a dehydrogenation reaction, and wherein a hydrophobic modifier is present on at least a portion of a surface of the second conducting component. The method further includes applying a voltage between the cathode exposed to the $CO_2$-containing fluid and the anode exposed to the hydrocarbon-containing fluid so as to facilitate adsorption of $CO_2$ onto the cathode and adsorption of the hydrocarbon onto the anode, wherein the voltage is sufficient to simultaneously oxidize the hydrocarbon via a dehydrogenation reaction and reduce the $CO_2$.

BRIEF DESCRIPTION OF THE DRAWING

The accompanying drawing, which is incorporated in and constitutes a part of this specification, illustrates embodiments of the present invention and, together with a general description of the invention given above, and the detailed description of the embodiments given below, serves to explain the principles of the present invention.

The FIGURE is a diagrammatical view of a simplified electrolytic cell for reducing carbon dioxide ($CO_2$) that is configured for flow cell processing, in accordance with an embodiment of the present invention.

DETAILED DESCRIPTION OF EMBODIMENTS OF THE INVENTION

An electrochemical method and electrochemical cell for reducing $CO_2$, dehydrogenating a hydrocarbon to an olefin, or a combination thereof are disclosed in various embodiments. However, one skilled in the relevant art will recognize that the various embodiments may be practiced without one or more of the specific details or with other replacement and/or additional methods, materials, or components. In other instances, well-known structures, materials, or operations are not shown or described in detail to avoid obscuring aspects of various embodiments of the present invention.

Similarly, for purposes of explanation, specific numbers, materials, and configurations are set forth in order to provide a thorough understanding. Nevertheless, the embodiments of the present invention may be practiced without specific details. Furthermore, it is understood that the illustrative representations are not necessarily drawn to scale.

Reference throughout this specification to "one embodiment" or "an embodiment" or variation thereof means that a particular feature, structure, material, or characteristic described in connection with the embodiment is included in at least one embodiment of the invention, but does not denote that they are present in every embodiment. Thus, the appearances of the phrases such as "in one embodiment" or "in an embodiment" in various places throughout this specification are not necessarily referring to the same embodiment of the invention. Furthermore, the particular features, structures, materials, or characteristics may be combined in any suitable manner in one or more embodiments. Various additional layers and/or structures may be included and/or described features may be omitted in other embodiments.

Additionally, it is to be understood that "a" or "an" may mean "one or more" unless explicitly stated otherwise.

Various operations will be described as multiple discrete operations in turn, in a manner that is most helpful in understanding the invention. However, the order of description should not be construed as to imply that these operations are necessarily order dependent. In particular, these operations need not be performed in the order of presentation. Operations described may be performed in a different order than the described embodiment.

Various additional operations may be performed and/or described operations may be omitted in additional embodiments.

To confront one or more of the limitations of prior art methods, a new process is provided that enables the concurrent oxidation of a hydrocarbon and the reduction of carbon dioxide ($CO_2$) to high value products; the process may be called the "HYCO2chem process." However, each of the half-reactions may be practiced independently, e.g., by substituting the hydrocarbon with a different reducing agent or by substituting $CO_2$ with a different oxidizing agent. Thus, in an embodiment, the HYCO2chem process includes an electrochemical cell designed with an architecture that will control the transport of the species required for the oxidation/reduction reactions. The FIGURE is a diagrammatic depiction of a simplified electrochemical cell 10 configured for flow cell processing. The simplified electrochemical cell 10 comprises a cathodic chamber 15 containing a cathode electrode 20, an anodic chamber 25 containing an anode electrode 30, wherein the cathodic chamber 15 and the anodic chamber 25 are physically separated from each other by a separator 35. However, while also serving as a physical barrier between the cathode electrode 20 and the anode electrode 30, the separator 35 allows the transport of ions between the anodic chamber 25 and the cathodic chamber 15. The cathode electrode 20 and the anode electrode 30 are configured with an electrical connection therebetween via a cathode lead 42 and an anode lead 44 along with a voltage source 45, which supplies a voltage or an electrical current to the electrochemical cell 10.

The cathodic chamber 15 comprises an inlet 50 by which an oxidizing agent-containing fluid 11 enters and an outlet 55 by which reduction product(s) and unreacted oxidizing agent 12 exit. The oxidizing agent may include, but is not limited to, carbon dioxide, oxygen, molecular halogens, metal ions, protons, or combinations thereof. Similarly, the anodic chamber 25 comprises an inlet 60 by which a reducing agent-containing fluid 13 enters and an outlet 65 by which oxidation product(s) and unreacted reducing agent 14 exit. The reducing agent may include, but is not limited to, hydrogen, hydrocarbons, amines, alcohols, coal, pet-coke, biomass, lignin, or combinations thereof. Each of the cathodic and anodic chambers 15, 25 may further comprise gas distributors 70, 75, respectively. The electrochemical cell 10 may be sealed at its upper and lower ends with an upper gasket 80 and a lower gasket 85.

Cathode

In accordance with an embodiment of the present invention, the cathode electrode 20 comprises a conducting component that is active toward adsorption and reduction of $CO_2$. Non-limiting examples of $CO_2$ reduction products include single carbon species like carbon monoxide (CO), formic acid ($HCO_2H$), methanol ($CH_3OH$), and/or methane ($CH_4$), or C2 products like oxalic acid ($HO_2C—CO_2H$), glycolic acid ($HO_2C—CH_2OH$), ethanol ($CH_3CH_2OH$), ethane ($CH_3CH_3$) and/or ethylene ($CH_2CH_2$). In accordance with an embodiment, $CO_2$ is reduced to produce at least ethylene, which takes place according to Equation 3 above.

In one embodiment, conducting component comprises an active catalyst selected from platinum (Pt), iridium (Ir), ruthenium (Ru), palladium (Pd), rhodium (Rh), nickel (Ni), cobalt (Co), iron (Fe), copper (Cu), silver (Ag), and their combinations. In another embodiment, the active catalyst includes one or more platinum-group metals, which includes ruthenium (Ru), rhodium (Rh), palladium (Pd), osmium (Os), iridium (Ir), and platinum (Pt). When a combination of one or more metals is used for the conducting component of the cathode electrode 20, the metals can be co-deposited as alloys as described in U.S. Pat. Nos. 7,485,211 and 7,803,264, and/or by layers as described in U.S. Pat. No. 8,216,956, wherein the entirety of these disclosures are incorporated by reference herein in their entirety. In one embodiment, where the metals are layered, the overlying layer of metal may incompletely cover the underlying layer of metal.

In accordance with an embodiment of the present invention, the cathode electrode may be constructed as a high surface area material, so as to increase the available surface area for the cathodic conducting component. Accordingly, the conducting component and/or active catalyst of the cathode may be present in a form, e.g., nanoparticles, that provides a high surface area material. Additionally, the cathode electrode may further include a substrate onto which the conducting component and/or active catalyst is applied. Non-limiting examples of suitable substrates include conductive metals, carbon fibers, carbon paper, glassy carbon, carbon nanofibers, carbon nanotubes, graphene, metal nanoparticles, nickel, nickel gauze, Raney nickel, alloys, etc.

Carbon dioxide feedstock is not particularly limited to any source and may be supplied to the carbon dioxide containing fluid as a pure gas or as a mixture of gases. Other inert gases (e.g., a carrier gas) can be present in the carbon dioxide containing fluid.

To enhance the distribution of carbon dioxide in the cathodic chamber 15, the gas distributor 70 (e.g., screen of metals) provides channels for the carbon dioxide to disperse and contact the cathode electrode 20. If desired, any excess or unreacted carbon dioxide gas that exits the cathodic chamber 15 can be separated from the reduction product(s) and recirculated in the process.

Anode

In accordance with an embodiment of the present invention, the anode electrode 30 comprises a conducting component that is active toward adsorption and oxidation of hydrocarbons via a dehydrogenation reaction.

In one embodiment, the conducting component of the anode electrode 30 comprises an active catalyst selected from platinum (Pt), iridium (Ir), ruthenium (Ru), palladium (Pd), rhodium (Rh), nickel (Ni), Cobalt (Co), iron (Fe), copper (Cu), and their combinations. In another embodiment, the active catalyst includes one or more platinum-group metals, which includes ruthenium (Ru), rhodium (Rh), palladium (Pd), osmium (Os), iridium (Ir), and platinum (Pt). When a combination of one or more metals is used for the conducting component of the anode electrode 30, the metals can be co-deposited as alloys as described in U.S. Pat. Nos. 7,485,211 and 7,803,264, and/or by layers as described in U.S. Pat. No. 8,216,956, wherein the entirety of these disclosures are incorporated by reference herein in their entirety. In one embodiment, where the metals are layered, the overlying layer of metal may incompletely cover the underlying layer of metal.

In accordance with an embodiment of the present invention, the anode electrode 30 may be constructed as a high surface area material, so as to increase the available surface area for the anodic conducting component. Accordingly, the conducting component and/or active catalyst of the anode may be present in a form, e.g., nanoparticles, that provides the high surface area material. Additionally, the anode electrode 30 may further include a substrate onto which the conducting component and/or active catalyst is applied. Non-limiting examples of suitable substrates include conductive metals, carbon fibers, carbon paper, glassy carbon, carbon nanofibers, graphene, carbon nanotubes, metal nanoparticles, nickel, nickel gauze, Raney nickel, alloys, etc.

In an embodiment, the hydrocarbon comprises ethane and its electrochemical dehydrogenation (i.e., oxidation) to ethylene will take place according to Equation (5).

$$C_2H_6 \rightleftharpoons C_2H_4+2H^++2e^- E^0=0.523\text{*V vs. SHE} \quad (5)$$

Accordingly, the overall electrochemical cell reaction, as shown in Equation (6), will take place at a cell voltage of 0.444 V, which represents a 61% reduction in the electrical energy when compared to the reaction shown in Equation (3). Other hydrocarbons, e.g., methane, propane, butane, pentane, hexane, etc. can also be oxidized, but ethylene is shown as an example.

$$6C_2H_6+2CO_2 \rightarrow 7C_2H_4+4H_2O \quad (6)$$

As another non-limiting example, the hydrocarbon comprises hexane and its electrochemical dehydrogenation (i.e., oxidation) to hexene will take place according to Equation (7).

$$C_6H_{14} \rightleftharpoons C_6H_{12}+2H^++2e^- \quad (7)$$

Accordingly, the reaction shown in Equation (7) coupled with the reduction of $CO_2$ to ethylene, which is shown in Equation (1), will lead to the production of high value olefins (hexene and ethylene, simultaneously) while minimizing $CO_2$ emissions, as shown in Equation (8). In this case, the overall cell reaction will take place at a cell voltage of 0.376 V, according to the thermodynamics, which represents a 67% reduction in the electrical energy when compared to the reaction shown in Equation (3).

$$6C_6H_{14}+2CO_2 \rightarrow 6C_6H_{12}+C_2H_4+4H_2O \quad (8)$$

The key to achieve the selective electrochemical dehydrogenation of the hydrocarbons is minimizing the presence of water that can lead to the parasitic oxidation of the hydrocarbons towards $CO_2$, which may be shown for ethane by the reverse reaction of Equation (1), for example. This parasitic oxidation of hydrocarbons is one of the reasons why electrochemical dehydrogenation of hydrocarbons has been studied at high temperature using ceramic type electrolytes. According to embodiments of the present invention, the anode electrode further includes a hydrophobic modifier on at least a portion of a surface of the conducting component and/or active catalyst. In an embodiment, the hydrophobic modifier includes an electrochemically reduced graphene oxide (ERGO) coating on the conducting component and/or active catalyst, which provides a hydrophobic-hydrophilic anodic surface. In another embodiment, the hydrophobic modifier includes a graphene film (for example, synthesized by chemical vapor deposition). In another environment, the hydrophobic material includes Teflon.

Thus according to an embodiment, the electrochemically reduced graphene oxide (ERGO)-coated anode electrode may be prepared by a one-step electrochemical synthesis on graphene oxide (GO) support. GO suspensions can be prepared by exfoliation of graphite by Hummers method or a modified Hummers method. The ERGO-coated anode electrode may be prepared by performing an electrochemical reduction of a GO-coated conducting component in an ionic solution (e.g., 0.1M KCl) that includes a salt or a compound of the active catalyst.

According to an embodiment, graphene can be directly lifted on a membrane and/or separator and coated with the active catalyst for the oxidation of the hydrocarbon.

In another environment, graphene sheets can be bounded with Teflon, nafion, or another binder.

Gas distribution channels (e.g., screen of metals) can be added to the anodic chamber to enhance the distribution of the gas among the anodic chamber 25. If desired, any excess or unreacted hydrocarbon that exits the anodic chamber 25 can be separated from the oxidation product(s) and recirculated in the process.

Separator

In accordance with another embodiment, when present, the separator 35 may divide the cathodic and anodic chambers 15, 25, and physically separate the cathode electrode 20 and the anode electrode 30. Exemplary separators include ion (e.g., proton or anion) exchange membranes, which are thin polymeric films that permit the passage of ions. In one embodiment, the separator includes a proton conducting polymer comprising a sulfonated tetrafluoroethylene-based fluoropolymer-copolymer. For example, the sulfonated tetrafluoroethylene-based fluoropolymer-copolymer may be ethanesulfonyl fluoride, 2-[1-[difluoro-[(trifluoroethenyl) oxy]methyl]-1,2,2,2-tetrafluoroethoxy]-1,1,2,2,-tetrafluoro-, with tetrafluoroethylene, which is commercially available from the E. I. du Pont de Nemours and Company, under the tradename Nafion®.

In accordance with embodiments of the present invention, the electrochemical cell 10 can be operated at a constant voltage or a constant current. While the electrochemical cell 10 is shown in a flow cell configuration, which can operate continuously, the present invention is not limited thereto.

The electrochemical cell 10 may incorporate the following features:

A. Flow Rate Controllers

In accordance with embodiments of the present invention, the flow rate of the $CO_2$ and the hydrocarbon through the cathodic and anodic chambers 15, 25, respectively, can be varied over a wide range, depending on a variety of factors, including but not limited to catalyst surface area, temperature, pressure, reduction efficiency of the $CO_2$ and oxidation efficiency of the hydrocarbon. In an embodiment, the flow rate of $CO_2$ is in a range from about 1 L/min to about 2,000 L/min.

B. Temperature Controllers

In accordance with embodiments of the present invention, the temperature of the cell can be in a range from about 25° C. to about 120° C.

C. Pressure Controllers

In accordance with embodiments of the present invention, the pressure of the cell can be in a range from about 1 atm to about 100 atm.

D. Humidifiers.

In accordance with embodiments of the present invention, the humidity of the $CO_2$-containing fluid and/or the hydrocarbon-containing fluid can be modulated to achieve a desired level. For example, the humidity may be increased or decreased, and may be in a range from less than about 1% to about 100% Relative Humidity (RH) at the operating temperature of the electrochemical cell.

EXAMPLE

Materials and methods: Graphite powder (C, grade #38), sulfuric acid ($H_2SO_4$, 96.3%), hydrochloric acid (HCl, 37.4%), potassium hydroxide (KOH, 85.0%+), potassium chloride (KCl, 99.6%), carbon dioxide ($CO_2$), ethane ($C_2H_6$), and hexane ($C_6H_{14}$) are obtainable from Fisher Scientific. Potassium permanganate ($KMnO_4$, 98%), sodium nitrate ($NaNO_3$, 98%+), hydrogen peroxide ($H_2O_2$, 29-32%), and chloroplatinic acid ($H_2PtCl_6.6H_2O$) are obtainable from Alfa Aeaser.

Graphene-platinum nanocomposites synthesis: Graphene oxide (GO) may be prepared by the modified Hummers method. A typical procedure for the synthesis of the GO involves the following steps:

a). 3 g of graphite powder and 1.5 g of $NaNO_3$ may be dissolved in a 400 mL beaker containing 100 mL of $H_2SO_4$ placed in an icewater bath. 12 g of $KMnO_4$ may be gradually added to the mixture in 1 h while stirring at 200 rpm with a 25.4 mm×9.5 mm magnetic stirring bar, and the resulting mixture may be continuously stirred at 200 rpm at room temperature overnight.

b). 150 mL of deionized $H_2O$ may be slowly added to the stirred mixture, and the diluted mixture may be further stirred at 200 rpm for 1 day. Afterwards, 15 mL of $H_2O_2$ may be added to the diluted mixture and stirred for an additional 2 hours.

c). The diluted mixture may then be washed with 5 wt % HCl, followed by centrifugation (Thermo Scientific Sorvall Legend X1 Centrifuge) at 4000 rpm for 10 min. This purification/washing process may be repeated as desired, e.g., 15 times. The remaining mixture may then be washed with deionized $H_2O$, followed by centrifugation at 4000 rpm for 10 min. The deionized $H_2O$ washing process may be repeated as desired, e.g., 5 times, to obtain the GO slurry.

d). The GO slurry may be dried at room temperature in a vacuum oven (about 25 in. of Hg vacuum) (Napco E Series, Model 5831) equipped with a vacuum pump (Gast, Model DDA-V191-AA) for 1 day to get GO powder. A GO dispersion may be prepared by sonication (Zenith Ultrasonic bath at 40 kHz) of the graphite oxide powder in deionized $H_2O$ for 30 min, followed by 10 min centrifugation at 1000 rpm. The concentration of the GO dispersion can be adjusted to about 0.2 mg/ml.

e). Glassy carbon electrodes (GCE, 5.0 mm diameter) may be first polished with 1 μm and 0.05 μm polishing alumina and rinsed with deionized water, and finally sonicated in deionized water for about 10 min to remove any alumina particles. After drying with an Argon flow, the polished GCEs may be used as representative substrates for electrochemical reduction of graphene oxide (ERGO) to form ERGO-catalyst nanocomposites. To prepare the nanocomposites, 20 μl of the GO dispersion may be first dropped on the polished GCEs. Drying at room temperature for about 1 h forms GO films on the GCEs. A one-step electrochemical reduction process may then be performed in 0.1 M KCl solution in the presence of 5 mM $H_2PtCl_6.6H_2O$ at −1.1 V vs. Ag/AgCl for 5 min with 60 rpm stirring for producing a pure electrochemically reduced graphene oxide (ERGO) electrode and an EGRO-Ni electrode, respectively. A platinum foil (e.g., 2 cm×1 cm) may be used as a counter electrode.

A membrane electrode assembly (MEA) may be built using the Graphene-Pt nanocomposite as the anode electrode or as both the anode and cathode electrode, using NAFION® as the membrane separator. The MEA may be assembled into the electrochemical cell 10 as depicted in the FIGURE. Toray TGP-H-030 carbon paper may be used as gas diffusion layers in both the anodic and cathodic chambers.

While the present invention was illustrated by the description of one or more embodiments thereof, and while the embodiments have been described in considerable detail, they are not intended to restrict or in any way limit the scope of the appended claims to such detail. Additional advantages and modifications will readily appear to those skilled in the art. The invention in its broader aspects is therefore not limited to the specific details, representative product and method, and illustrative examples shown and described. Accordingly, departures may be made from such details without departing from the scope of the general inventive concept embraced by the following claims.

What is claimed is:

1. A method for electrolytically reducing a carbon dioxide and dehydrogenating a hydrocarbon to an olefin in an electrochemical cell comprising an anode, a cathode, and a separator, the method comprising:

exposing the cathode comprising a first conducting component comprising a first nanoparticle to a first fluid containing the carbon dioxide ($CO_2$) at a first pressure and first temperature, wherein the first conducting component is active toward adsorption and oxidation of the $CO_2$, and the first conducting component is selected from the group consisting of platinum (Pt), iridium (Ir), ruthenium (Ru), palladium (Pd), rhodium (Rh), osmium (Os), nickel (Ni), cobalt (Co), iron (Fe), copper (Cu), and their combinations;

exposing the anode comprising a second conducting component to a second fluid containing the hydrocarbon at a second pressure and a second temperature, wherein the second conducting component is active toward adsorption and reduction of the hydrocarbon, the second conducting component is selected from the group consisting of platinum (Pt), iridium (Ir), ruthenium (Ru), palladium (Pd), rhodium (Rh), nickel (Ni), cobalt (Co), iron (Fe), copper (Cu), and their combinations, the second conducting component being layered on an anode substrate surface, an overlying layer of the second conducting component incompletely covering an underlying layer of the second conducting component, and wherein a hydrophobic modifier comprising an electrochemically reduced graphene oxide coating is present on both the first conducting component and the second conducting component; and applying a voltage between the cathode exposed to the first fluid and the anode exposed to the second fluid so as to facilitate adsorption of the $CO_2$ onto the cathode and adsorption of the hydrocarbon onto the anode, wherein the voltage is sufficient to simultaneously oxidize the hydrocarbon to a first olefin via a dehydrogenation reaction and reduce the $CO_2$ to form a second olefin.

2. The method of claim 1, wherein the second conducting component comprises platinum.

3. The method of claim 1, wherein the hydrocarbon is selected from gaseous methane, ethane, propane, butane, pentane, and hexane.

4. The method of claim 1, further comprising:

dispersing a graphene oxide powder in distilled water to form a graphene oxide dispersion;

depositing the graphene oxide dispersion onto the first conducting component and the second conducting component;

drying the graphene oxide dispersion to form a graphene oxide film on the first conducting component and the second conducting component; and electrochemically reducing the graphene oxide film on the first conducting component and the second conducting component to form the hydrophobic modifier comprising the electrochemically reduced graphene oxide coating.

5. The method of claim 1, wherein the cathode comprises a substrate onto which the first conducting component is applied.

6. The method of claim 1, wherein the second conducting component comprises a second nanoparticle.

* * * * *